United States Patent [19]

Dahnert

[11] Patent Number: 5,044,703

[45] Date of Patent: Sep. 3, 1991

[54] LIMIT SWITCH ASSEMBLY FOR MOBILE STORAGE APPARATUS

[75] Inventor: Dean L. Dahnert, Fort Atkinson, Wis.

[73] Assignee: Spacesaver Corporation, Fort Atkinson, Wis.

[21] Appl. No.: 638,070

[22] Filed: Jan. 7, 1991

Related U.S. Application Data

[62] Division of Ser. No. 471,256, Mar. 9, 1990, Pat. No. 5,005,923.

[51] Int. Cl.[5] ..... A47B 53/00

[52] U.S. Cl. ..... 312/201

[58] Field of Search ..... 312/198, 199, 200, 201

[56] References Cited

U.S. PATENT DOCUMENTS

| | | | |
|---|---|---|---|
| 3,957,322 | 5/1976 | Mastronardi et al. | 312/201 |
| 4,745,516 | 5/1988 | Griffin | 312/201 X |
| 4,759,592 | 7/1988 | Dahnert | 312/201 |
| 4,783,618 | 11/1988 | Artrip | 312/201 |

*Primary Examiner*—Joseph Falk

*Attorney, Agent, or Firm*—Fuller, Ryan & Hohenfeldt

[57] ABSTRACT

A limit switch assembly for mounting on mobile storage units has first and second limit switches secured in spaced relationship. A switch operating rod is spring biased to extend from the assembly by a predetermined amount into an open aisle or where there is no proximate storage unit and there is a cam element on the rod which holds the first switch in closed circuit condition to enable a motor on the unit and drive it into the open aisle space and when the rod touches a stop as the unit means reached the limit of its travel the cam shifts to open the first switch to initiate a deceleration interval which terminates when the cam retracts enough to open the second switch which disables the motor. The rod on the limit switch assembly of the next trailing storage unit begins to extend when the leading unit moves a small amount in which case the cam on the trailing unit only needs to move a small amount to close the first limit switch on the trailing unit so it begins to accelerate while the leading unit is still accelerating. The trailing unit and any subsequent trailing units go through the same deceleration and stopping cycle performed by the first unit.

1 Claim, 1 Drawing Sheet

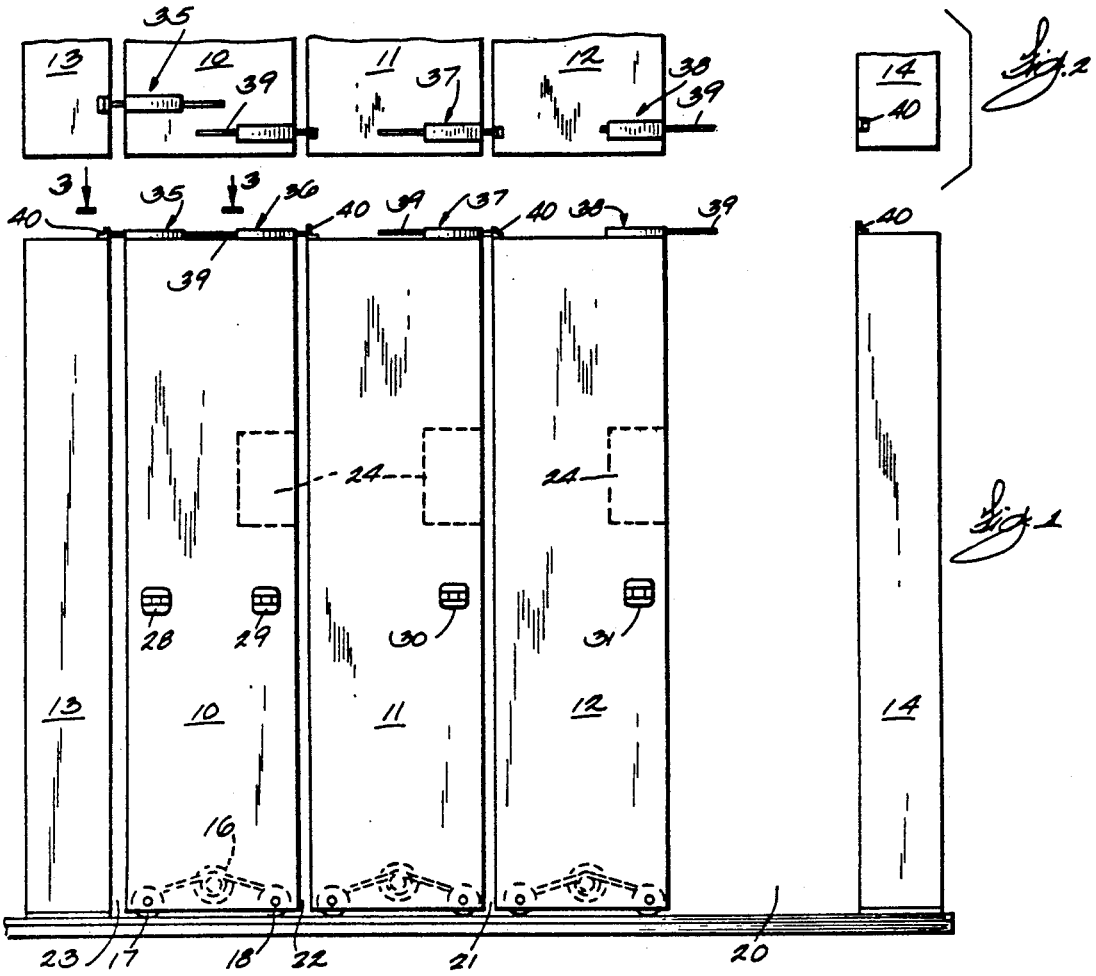
Fig. 2
Fig. 1
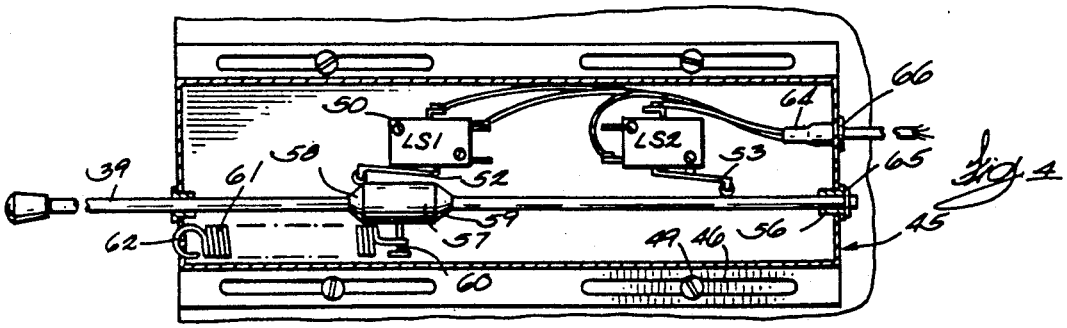
Fig. 4
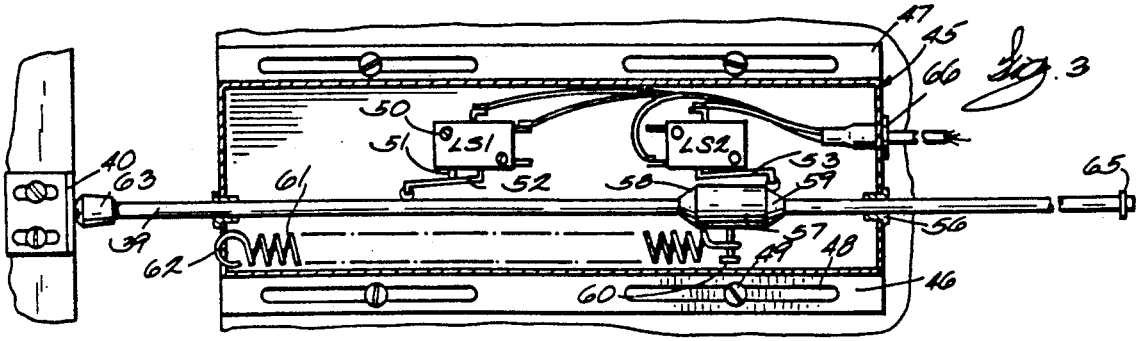
Fig. 3

LIMIT SWITCH ASSEMBLY FOR MOBILE STORAGE APPARATUS

This is a divisional of copending applications Ser. No. 07/491,256 filed on Mar. 9, 1990, now U.S. Pat. No. 5,005,923.

BACKGROUND OF THE INVENTION

This invention pertains to movable storage systems wherein a series of storage units having shelves or bins are supported on wheeled carriages to provide for moving the units on tracks to create an access aisle between any two of the units and to establish the others in close side-by-side relationship to minimize the amount of floor space required for the units There is a reversible electric motor mounted on each of the storage units so the units can be driven in either direction along the tracks. In particular, the invention resides in a new limit switch assembly which is capable of governing the time at which acceleration and deceleration of the units occurs as they are moved in series to close a presently open aisle and to thereby create the space for opening a presently closed aisle between units.

Details of the electrical controllers which are mounted on the individual movable storage units and a more extensive description of all of the structural and operating features of a mobile storage system are described in U.S. Pat. No. 4,759,592 whose entire disclosure is incorporated herein by reference. The patent is owned by the Assignee of this application.

Storage unit systems customarily have several mobile storage units arranged to run on tracks between two spaced apart stationary storage units. The number of mobile storage units in the system is usually one less than the number which would be required to fill all of the space between the fixed storage units so that there is always one open aisle in existence which can be entered by a person to gain access to shelves on storage units adjacent each side of the aisle. It is customary to have manually operable push button switches mounted to the upright end walls of the storage units such that when opening of a particular aisle is desired, the user will press one of the push buttons immediately adjacent the aisle which is closed and is to be opened. In the more advanced mobile storage unit systems such as the one described in the patent mentioned above, pressing the push button issues a command signal which is interpreted by a microprocessor in a controller on each of the mobile storage units in a manner that determines which way the storage units should be driven in sequence to close the open aisle and open the presently closed aisle. Typically, the mobile storage unit which is adjacent the open aisle will be the first one to begin moving toward closing that aisle. According to the prior practice, the first unit to move would have to move a substantial distance before the second unit would begin to move and there would be subsequent corresponding delays from unit to unit so that the time required to close one aisle and open another by shifting the mobile units therebetween was not minimized. The fact that the aisle opening time is not minimized in the prior art is a consequence of the type of limit switches which have been used to stop movement in response to a moving unit butting against a stationary unit. Typically, single pole limit switches were used. A spring biased rod usually extends outwardly from the switch housing into an open aisle, for instance, such that when the first movable unit adjacent the open aisle approaches a stationary mobile storage unit or a unit at the end of the series of mobile units, the rod strikes a stop on the stationary unit and begins to retract into the limit switch. When the rod is retracted against the force of the spring sufficiently far, an actuator on the rod actuates the limit switch, that is, it opens the limit switch and brings about deenergization of the driving motor on that particular storage unit. Usually the moving unit coasts for a short distance after the limit switch opened.

The prior art limit switch operating rod on the mobile storage unit adjacent the open aisle would, of course, extend into the free space between this first unit that would have to be moved and a stationary unit. With the operating rod extended, the limit switch on the first unit adjacent the open aisle would be in closed circuit condition so that it could move in response to the controller on this unit interpreting the signal produced by the use of the push button next to the closed aisle as a command to start moving all of the mobile units in the appropriate direction to close the open aisle and open the closed aisle. Of course, all of the limit switch operating rods on the storage units which trail the first unit that is to be moved toward the open aisle are extended initially which means that their limit switches were in open circuit condition so as to prohibit movement until the unit in the forward direction moved far enough away from the next succeeding unit to allow the operating rod to extend and dispose the successive limit switches in closed circuit condition. Thus, according to prior practice, when a command occurred that would cause the units to move sequentially in the proper direction to close an aisle and open another one, the first unit adjacent the open aisle had its limit switch in condition for it to begin moving in the proper direction to close the aisle. The first unit would experience an acceleration interval and then get up to full speed and finally stop when the limit switch was actuated. The first unit had to complete the acceleration interval before the unit moved far enough away from the next trailing unit to permit its limit switch to close and begin an acceleration interval. Usually the first unit would have to move about 4" before the next trailing unit would begin to move and this kind of delay accumulated all the way down the line to the last unit that would begin movement adjacent the place where an aisle was to be opened. Thus, the gap between units was substantial and total time for opening an aisle was not minimized.

Besides the delay that occurred in making the moves to open and close aisles when prior art limit switches are used, another undesirable feature is that the storage units start and stop abruptly rather than smoothly and inconspicuously as users of the equipment would desire.

SUMMARY OF THE INVENTION

One object of the invention is to provide a new limit switch assembly which, in conjunction with closing an aisle, allows the mobile storage unit that follows the unit which begins to move first into the open aisle space to begin moving an instant after the first mobile unit begins to move. In other words, the mobile unit following the first unit begins to accelerate up to speed while the leading or first unit next to the open aisle is still accelerating. Thus, the gap between the first and next following unit can be very small. Moreover, as soon as the second unit moves a bit, the third unit begins to accelerate while the second unit is still accelerating so it follows the second unit very closely. This action is propagated all the way down the line to the series of mobile storage units. The new limit switch assembly provides for the units starting in a controlled acceleration mode such that they start moving smoothly and in a short distance they reach full operating speed. The new limit switch assembly also provides for controlled deceleration of the movable storage units before they stop.

Another objective of the new switch assembly is to bring about smooth deceleration of the units over an interval such as by way of example and not limitation, over a distance of 4" of storage unit travel before events in the limit switch assembly occur which allow the mobile unit to come to a complete stop. This objective is achieved by using two switches in each limit switch assembly and by actuating these limit switches by means of a cam which is mounted to the switch operating rod.

The manner in which the foregoing objectives and other more specific objectives of the invention are achieved will be evident in the more detailed description of a preferred embodiment of the invention which will now be set forth in reference to the drawing.

DESCRIPTION OF THE DRAWING

FIG. 1 is a diagram of a plurality of movable storage units among which some of the units are in contact with each other and other units are separated from each other to provide an aisle to give the user access to the shelves or bins on the interfacing sides of the units;

FIG. 2 is a plan view of the storage unit system diagrammed in FIG. 1;

FIG. 3 depicts the new limit switch assembly which contains two limit switches and has its switch operating rod presently retracted or pushed into the switch assembly housing as is the case when the rod of a limit switch on one of the mobile storage units has abutted a mobile or fixed storage unit; and FIG. 4 shows the new limit switch assembly with its operating rod fully extended from the housing as would be the case if the switch assembly in this FIGURE were on a storage unit which is adjacent an open aisle.

DESCRIPTION OF A PREFERRED EMBODIMENT

FIG. 1 is a front elevational diagrammatic view of several storage units that are arranged to move alternately and selectively to the left and right to establish an access aisle between them at the command of an user. In this particular installation there are only three mobile storage units 10, 11 and 12. FIG. 1 shows the upright end walls of these units. The mobile units are arranged between stationary units 13 and 14 which could be the walls of a room as well. The mobile units run on floor mounted tracks which are generally designated by the numeral 15. There is a reversible electric motor mounted in each one of the storage units and this motor is symbolized by the dashed line circle marked 16 in typical mobile unit 10. In reality, as exhibited in the patent cited above, the mobile storage units are supported on carriages, not shown, which have a set of four wheels. Typical two wheels 17 and 18 of the set which are visible on unit 10 run on tracks 15. The motor 16 is symbolically coupled in driving relation to the shafts for these wheels by means of closed loop drive chains such as the one marked 19.

Presently, there is an open aisle marked 20 in FIGURE between mobile storage unit 12 and stationary unit 14. There are presently small spaces 21, 22 and 23 between the other units and as is known, anyone of these spaces can be enlarged to the full width of an aisle such as aisle 20 by moving units or a unit to the right of a space so as to close aisle 20 and provide for enlarging a space between units to full aisle size.

There is a box such as the one marked 24 and shown in dashed lines mounted behind the end wall of each one of the mobile storage units 10–12. These boxes contain electrical components which comprise controllers for the motors on the respective mobile storage units The patent cited above illustrates the kind of control equipment that may be contained in controller boxes 24. There are two push button assemblies 28 and 29 on mobile storage unit 10. There are single push button assemblies 30 and 31 on mobile storage units 11 and 12, respectively. The user always uses a push button assembly next to a space between storage units which the user desires to convert from a narrow space to a user accessible aisle. For instance, if the user desires to convert narrow space 23 into a full aisle, the user would press a push button in push button assembly 28. This provides a common signal to the controller 24 on storage unit 10 which the controller would interpret as a command to move all units to the right to open the aisle. As is illustrated in the patent cited above and other patents, this command is also interpreted by the controllers 24 in the other units in a manner which will result in the storage units moving in sequence and in the proper direction to bring about opening of the selected aisle. Where the storage units happen to be arranged as they are in FIG. 1, issuing the command by operation of push button 28 would result in storage unit 12, adjacent open aisle 20, beginning to drive to the right towards stationary unit 14 to close that aisle. The trailing or following units 11 and 10 would also move to the right by the same amount that the leading storage unit 12 has moved to bring about opening of aisle 23. If, as another example, it were desired to expand the space 21 between storage units 11 and 12 into an open aisle, push button 30 would be used and only storage unit 12 would move to the right to close aisle 20 and open aisle 21. In an actual embodiment there are flexible multiconductor cables, not shown, draped between adjacent storage units for transferring information which has been translated into electric signals between the controllers 24 in the various mobile storage units. Thus, when a move command signal is issued, all of the controllers use it as a basis for making a decision as to whether they should cause their on-board electric drive motors 16 to run in one direction or the other to effect opening of an aisle.

FIGS. 1 and 2 show the new limit switch assemblies mounted on top of the mobile storage units. All limit switch assemblies are identical. There are two limit switch assemblies 35 and 36 on mobile storage unit 10. There is one limit switch assembly 37 on mobile storage unit 11 and one assembly 38 on storage unit 12. Each of the limit switch assemblies has a plunger or switch operating rod such as the one marked 39 extending outwardly from the limit switch housing into the open space constituted by aisle 20. If mobile unit 12 moves toward stationary unit 14, rod 39 will strike a stop element 40 on stationary unit 14 eventually and rod 39 will be retracted or pushed into the housing of limit switch assembly 38 to perform some switch operating functions as will be explained shortly hereinafter. There are stops corresponding to stop 40 on stationary unit 13 and mobile units 11 and 12 in this particular installation.

Attention is now invited to FIG. 3 for a description of the structural elements comprising one of the new limit switch assemblies The limit switch assembly comprises a mounting base member in the form of a sheet metal housing 45 which has flanges 46 and 47 extending from it. Typical flange 46 has slots such as the one marked 48 which provide for clamping the housing on top of a storage unit by means of four screws such as the one marked 49. The slots 48 allow the housing to be positioned adjustably so that the limit switch acts at the proper time during movement of the storage units There are two miniature switches LS1 and LS2 in each limit switch assembly fastened by means of bolts 50 to the limit switch housing 45. A switch operating plunger 51 extends from limit switch LS1 which is typical In FIG. 3 it is presently fully extended and is bearing against a switch actuator lever 52 when pivoted clockwise changes the state of switch LS1. Switch LS1 in FIG. 3 is not actuated and is in its normally open circuited state. Switch LS2 in FIG. 3 is a normally closed switch but it is presently actuated by its operating lever 53 so that LS2 is presently open circuited. There is a limit switch operating rod 54 extending through the housing in FIG. 3 There are bushings 55 and 56 through which switch operating rod 54 can slide. A cylindrical cam element 57 is fastened to switch operating rod 54. Truncated conical cam surfaces 58 and 59 are formed on cylindrical element 57. The cam surfaces could be rounded or otherwise tapered instead of being conical and it is not necessary that they be annular or formed on a single element but they must be axially spaced apart. Cam surface 59 has actuated lever 53 as depicted in FIG. 3 with the result that normally closed switch LS2 is presently open circuited in addition to switch LS1 being open. A pin 60 extends from cam cylinder 57 and one end of a coil spring 61 is hooked onto pin 60 while the other end 62 of the spring is hooked into an appropriate hole in the wall of the limit switch housing 45. A stop element in the form of a snap ring 65 is fastened to switch operating rod 54 to assure that cam surface 58 is actuating LS1 when the spring has pulled the rod to its left limit and to prevent the spring from pulling the rod out of the housing.

In FIG. 3, the switch operating rod or plunger 54 is in retracted condition. That is, it is pushed back into the housing by reason of its tip 63 having run into a stop 40 which may be a stop that is mounted to either of the stationary units 13 or 14 or a corresponding stop that is mounted to one of the mobile units that is adjacent the mobile unit on which the limit switch in FIG. 3 is mounted. When the switch operating rod 54 is retracted as it is in FIG. 3, coil spring 61 becomes stretched or loaded so as to have a tendency to advance or extend the limit switch operating rod 54 outwardly of the housing as is the case in FIG. 4.

In FIG. 4, the limit switch is at a substantial distance from any stop 40 so that spring 61 has caused rod 54 to be fully extended out of the housing 45. In this case, cam surface 58 has encountered the operating lever 52 of limit switch LS1 which is a normally open switch but is presently actuated by cam 58 so it is in a closed circuit condition as depicted in FIG. 4. LS2, on the other hand, has come off of cam surface 59 at this time and, since it is a normally closed switch, it is now closed. Thus, in FIG. 4, when the switch operating rod 54 is fully extended, both switches LS1 and LS2 are in closed circuit condition. The conductors leading from the limit switches LS1 and LS2 comprise a cable 64 which runs through an insulating bushing 66 and, although the conductors are shown interrupted in FIG. 3, they do connect into appropriate places in the circuitry contained in controller boxes 24 in the mobile storage units.

Assume now that it is desired to open an aisle between a pair of storage units such as between stationary storage unit 13 and mobile unit 10. This means that the narrow space 23 will be expanded into an aisle by moving the storage units 10-12 concurrently to the right and closing presently open aisle 20 in FIG. 1 The switch operating rod 39 of limit switch assembly 38 on mobile unit 12 in FIG. 1 is presently extended out into presently open aisle 30. In other words, limit switch assembly 38 and its switches LS1 and LS2 are presently in the closed circuit condition in which they exist in FIG. 4. A signal commanding opening of aisle 23 is issued by the user using push button 28 adjacent that prospective aisle. All of the interconnected controllers 24 determine that aisle 20 is presently open and that they must cause the carriage motors 16 in FIG. 1 to drive all of the mobile storage units 10, 11 and 12 in this example to the right.

Substantially concurrently with issuance of the command signal resulting from operating push button switch 28, mobile storage unit 12 begins to drive to the right At the outset, unit 12 accelerates for a short interval of about 2 seconds in this example after which its motor and the unit reach full operating speed. No change in the running condition takes place for a while but eventually limit switch operating rod 39 will run into stop 40 on stationary storage unit 14 so as to bring about retraction of rod 39 into the housing of limit switch assembly 38. Before the tip of rod 39 touches stop 40 on stationary unit 14, the switch assembly is in the condition of the assembly depicted in FIG. 4. A moment after the tip of the rod meets the stop 40, cam surface 58 which is presently holding LS1 in closed circuit condition moves to cause switch LS1 to change open circuit condition. At the instant LS1 opens, a signal corresponding to this logical state is transmitted by its wires extending through cable 64 to its controller 24 which brings about initiation of a deceleration phase, that is, the drive motor speed begins to slow down Deceleration continues until the cam surface 59 of the cylindrical cam element 57 actuates the lever 53 of limit switch LS2 at which time switch LS2 changes to the open circuit condition in which it is depicted in FIG. 3. When LS2 opens as is the case in FIG. 3, electric power to the motor is discontinued by the controller 24 and the storage unit 12 comes to an immediate stop. In one commercial embodiment of the invention, deceleration, as well as acceleration, occurs during a 2 second interval. In the same embodiment deceleration occurs over a 3.75" span of movement of the storage unit. Acceleration also occurs while the storage unit was traversing its first 3.75" of travel. Shortening and lengthening the cam cylinder 57 would, respectively, increase and decrease deceleration time and distance.

What happens to storage unit 11 and other units at the moment storage unit 12 began to move will now be considered. Note in FIG. 1 that before the command to close aisle 20 and open aisle 23 was given, the switch operating rod 39 of limit switch assembly 37 on the next in line mobile storage unit 11 was retracted or pushed in. This condition of the limit switch assembly is illustrated in FIG. 3. In this case, switch LS1 is not actuated and is in an open circuit condition. Switch LS2, on the other hand, is actuated but since it is normally closed it is presently in an open circuit state in FIG. 3. Note that cam surface 59 is positioned so that it is actuating LS2 into an open circuit state and that spring 61 is stretched or extended. At the time that the move command was received by the various electrical controllers 24, the switch actuator rod 39 of limit switch assembly 37 was being restrained in retracted condition by reason of the rod pressing against the stop 40 on the first or leading mobile storage unit 12. As soon as storage unit 12 moved an essentially trivial amount as previously described, spring 61 is limit switch assembly 37 began to draw rod 39 outwardly and this slight amount of motion caused switch LS2 operating lever 53 to roll off of cam 59 in which case switch LS2 closed. At that instant, the drive motor 16 on storage unit 11 began to accelerate as did the storage unit so that storage unit 11 was accelerating even though the leading storage unit 12 had not completed its acceleration phase. Recall that there is about 2 seconds of acceleration time in the described embodiment and that there is acceleration during the first 3.75" of mobile storage unit travel. The first or leading storage unit 12 will lead the trailing or second storage unit 11, due to the first storage unit coming up to full speed sooner, sufficiently for switch operating rod 39 of limit switch assembly 37 to extend partially under the influence of coil spring 61. Cam surface 58 thereby actuates operating lever 52 of LS1 in which case the circuit in LS1 closes as illustrated in FIG. 4. The next thing that happens is for push rod 39, of limit switch assembly 38 to be further retracted by running against the stop 40 on the leading or first mobile storage unit 12 in which case the cam surface 58 departs from the switch operating lever 52 and the LS1 switching circuit opens. This constitutes the beginning of a deceleration interval which terminates such that the leading storage unit 12 will come to a stop when cam surface 59 actuates operating lever 53 of switch LS2 to thereby open switch LS2. Of course, these changes in switch states are interpreted by the microprocessor based controllers 24 so that they exercise proper control over the drive motors 16 on the individual storage units.

It should be evident from the description presented thus far that at the moment the second storage unit 11 begins to move, the rod 39 on limit switch 36 will begin to extend such that cam 59 on cylindrical element 57 will depart from switch operating lever 53 of LS2 which will, as a consequence, start the acceleration interval of unit 10 in a moment after the preceding storage unit 11 begins to accelerate Unit 10 will then be brought to a stop in the matter just described in reference to the second storage unit 11. The sequential acceleration procedure just described has been demonstrated to result in the units all units beginning to move with minimum delay and with a smoothness that has not heretofore been achieved.

It should be evident that the operating cycle of the limit switch assemblies are similar to what has been described regardless of the number of mobile storage units in an installation.

The operating sequence is similar regardless of whether it is necessary to move storage units to the right or left to close an aisle or open an aisle. Assume for now, for example, that storage unit 12 is presently occupying the space assigned to aisle 20 and that the next storage unit 11 is up against storage unit 12. Storage unit 10 remains in the position in which it is shown in FIG. 1. This means that aisle 22 is presently open. If it were desired to close aisle 22 and open aisle 20, the user would press push button 31 on the storage unit 12 At the outset, switch actuator rod 39 of limit switch assembly 38 and switch actuator rod 39 of limit switch assembly 37 on storage units 12 and 11, respectively, would be retracted or pushed in to the switch housing. Switch actuator rod 39 of limit switch assembly 36 on storage unit 10 would be extended Mobile storage unit 11 would be the first one to move when the command is given to open aisle 20 and concomitantly close aisle 22. At the outset the controller 24 would ignore the condition of the switches LS1 and LS2 in the limit switch assemblies 37 and 38 of storage units 11 and 12, respectively. When the switch assembly 36 of mobile storage unit 10 which will not move at all in connection with opening aisle 20 and closing aisle 22.

I claim:

1. A method of opening and closing aisles among a row of mobile storage units which are mounted on wheels for running on tracks and each mobile storage unit has a reversible electric motor for driving said units in opposite directions longitudinally of the tracks, said method comprising:

energizing the motor on the leading mobile storage unit adjacent an aisle which is presently open to initiate acceleration of said mobile storage unit on the way to full speed in a direction for closing the aisle, energizing the motor on the next trailing mobile storage unit in the row which trails said leading mobile storage unit to begin accelerating said trailing mobile unit on the way to full speed in the same direction as said leading mobile storage unit traveling immediately after said leading mobile storage unit starts to accelerate and is still accelerating, initiating deceleration of said motor on said leading mobile storage unit when said unit is near the end of the travel required to close said aisle, deenergizing said motor on said leading mobile storage unit at the end of the deceleration interval and letting the leading mobile storage unit coast to a stop, next initiating deceleration of the motor on said trailing mobile unit when it has moved to within a predetermined distance from said leading mobile storage unit and, finally deenergizing said motor on said trailing mobile storage unit at the end of its deceleration interval for enabling said trailing unit to come to a stop.

* * * * *